US010720001B1

(12) United States Patent
Grosberg

(10) Patent No.: US 10,720,001 B1
(45) **Date of Patent: *Jul. 21, 2020**

(54) SYSTEM AND METHOD FOR VERIFIED ADMISSION THROUGH ACCESS CONTROLLED LOCATIONS

(71) Applicant: Mark Y. Grosberg, Boca Raton, FL (US)

(72) Inventor: Mark Y. Grosberg, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/267,513

(22) Filed: Feb. 5, 2019

Related U.S. Application Data

(63) Continuation-in-part of application No. 14/677,451, filed on Apr. 2, 2015, now Pat. No. 10,360,363.

(51) Int. Cl.

| | |
|---|---|
| ***G07C 9/27*** | (2020.01) |
| ***G07C 9/28*** | (2020.01) |
| ***G07C 9/29*** | (2020.01) |
| ***G07C 9/20*** | (2020.01) |

(52) U.S. Cl.
CPC ..... *G07C 9/27* (2020.01); *G07C 9/215* (2020.01); *G07C 9/28* (2020.01); *G07C 9/29* (2020.01)

(58) Field of Classification Search
CPC ..... G07C 9/00023; G07C 9/00119; G07C 9/00103; G07C 9/00111
See application file for complete search history.

(56) References Cited

U.S. PATENT DOCUMENTS

| | | | |
|---|---|---|---|
| 6,513,119 | B1 | 1/2003 | Wenzel |
| 7,119,674 | B2 | 10/2006 | Sefton |
| 7,222,241 | B2 | 5/2007 | Milgramm et al. |
| 7,377,426 | B1 | 5/2008 | Makeever |
| 7,441,004 | B2 | 10/2008 | Lue Chee Lip et al. |
| 8,040,216 | B2 | 10/2011 | Jordan et al. |
| 8,058,971 | B2 | 11/2011 | Harkins et al. |
| 8,254,631 | B2 | 8/2012 | Bongard |
| 8,671,143 | B2 | 3/2014 | Lewis |
| 8,787,886 | B2 | 7/2014 | Jonsson |
| 9,640,002 | B1 | 5/2017 | Grosberg |
| 2005/0114192 | A1 | 5/2005 | Tor et al. |

(Continued)

FOREIGN PATENT DOCUMENTS

WO 2013034671 3/2013

*Primary Examiner* — Alexander Lagor
*Assistant Examiner* — William B Jones
(74) *Attorney, Agent, or Firm* — Hanrahan Law Firm, P.A.; Benjamin M. Hanrahan

(57) ABSTRACT

A system and method for verifying entry credentials and activating/deactivating an access control system is disclosed herein. Particularly, the system and method include an embedded local control device attached or communicative with an electronic gate or lock. The control device is communicative with a remote access control management system, which is structured to receive, track and manage access tokens that can be used to control access to a gated community or other secured location. For each access token, a lookup key is generated, which is used in conjunction with a bijective transformation process to thereby generate a unique access code. The unique access code can be used to enter the electronic gate or lock, provided that any associated access restrictions, such as date and time, are also validated.

14 Claims, 14 Drawing Sheets

(56) References Cited

U.S. PATENT DOCUMENTS

| | | | | |
|---|---|---|---|---|
| 2005/0119052 | A1 | 6/2005 | Russell et al. | |
| 2007/0248219 | A1 | 10/2007 | Foster et al. | |
| 2007/0287413 | A1 | 12/2007 | Kleitsch et al. | |
| 2008/0212771 | A1* | 9/2008 | Hauser | G06F 21/305 380/44 |
| 2010/0211649 | A1 | 8/2010 | Dimas et al. | |
| 2010/0223170 | A1 | 9/2010 | Bahar | |
| 2010/0306549 | A1 | 12/2010 | Ullmann | |
| 2011/0012732 | A1 | 1/2011 | Farkash et al. | |
| 2012/0188054 | A1* | 7/2012 | Bongard | G07C 9/00309 340/5.61 |
| 2012/0255994 | A1* | 10/2012 | Silbernagl | G06Q 20/14 235/379 |
| 2012/0297190 | A1 | 11/2012 | Shen et al. | |
| 2013/0017812 | A1 | 1/2013 | Foster | |
| 2013/0031611 | A1 | 1/2013 | Barreto | |
| 2013/0048720 | A1 | 2/2013 | Lewis | |
| 2013/0057695 | A1 | 3/2013 | Huisking | |
| 2013/0214041 | A1 | 8/2013 | Wright | |
| 2013/0257590 | A1 | 10/2013 | Kuenzi et al. | |
| 2013/0292467 | A1 | 11/2013 | Avs et al. | |
| 2014/0085087 | A1 | 3/2014 | Alnadwi | |
| 2014/0232522 | A1 | 8/2014 | Schmidt-Lackner et al. | |
| 2015/0278548 | A1 | 10/2015 | Brands | |
| 2017/0300372 | A1* | 10/2017 | Andreopoulos | G06F 21/54 |

* cited by examiner

350

```
function PinFromSequence(SeqNo)
    value ← SeqNo ⊕ KEY                                   ▷ Ensure a more even distribution of bits
    mask ← (1 « OFFS) − 1                                 ▷ Generate a mask for a portion of the value
    ext ← value & ∼ mask                                  ▷ Extract the bits outside of the mask
    portion ← value & mask                                ▷ Extract the bits inside the mask
    rotated ← (portion » count) | (portion « (SIZE − COUNT))   ▷ Rotate the masked bits right
    hashed ←formatted as decimal((rotated & mask) | ext)  ▷ Combine both portions
    while len(hashed) < #DIGITS do
        hashed ←' 0' · hashed                             ▷ Pad to the required length
    check ← ComputeDammCheck(hashed)
    return(check · hashed)
```

Figure 11

SYSTEM AND METHOD FOR VERIFIED ADMISSION THROUGH ACCESS CONTROLLED LOCATIONS

The present application is a Continuation-In-Part patent application of previously-filed, U.S. patent application Ser. No. 14/677,451, filed on Apr. 2, 2015, the contents of which are incorporated herein in their entirety by reference.

FIELD OF THE INVENTION

The present invention is directed to a system and method for verifying entry credentials and activating/deactivating an access control system in order to permit ingress or egress there through. The access control system may include a gate, such as a vehicle gate positioned at an entrance/exit of a residential community, parking garage, etc. Other embodiments of the access control system may include locked doors, entryways, walkways, lobby doors, electronic door strikes, etc.

BACKGROUND OF THE INVENTION

A number of residential and commercial communities throughout the United States and Worldwide employ secure access gates, for example, at one or more entrances thereof. For instance, many of these communities include manned security or an electric gate to limit access or entry to the residents and their guests. Particularly, guests typically enter a gated or secured community by interacting with a security guard who confirms the guest is allowed entry, e.g., via a precompiled list of authorized guests or by contacting the resident and confirming the guest is authorized for entry. Another manner in which guests may typically enter a gated or secured community may be by using an electronic device positioned at or near the gate which can call the resident or home owner, who then signals using, for example, dual-tone multi-frequency (DTMF) signaling that the gate should open.

These approaches have some significant drawbacks. For example, in the situation with the guard, it takes time for each resident to interact with the guard, potentially increasing the wait time for the guests. In addition, the guard must confirm that the driver is the intended guest, for example, by checking identification or other documents that could potentially be forged or fictitious.

With regard to the electronic systems, when a household has multiple residents, the system oftentimes does not work or function as intended, as each resident will typically have their own mobile phone number, and there is no guarantee that the number programmed in the electronic device or "call box" is accurate, up-to-date, or will reach the intended recipient. Some systems may even require that the household include a dedicated plain old telephone service (POTS) line. Furthermore, the call boxes and electronic systems often have poor audio quality and performance rates. Additionally, the driver or guest must open his or her vehicle window to interact with the system, thereby exposing himself or herself to the outer elements, often an inconvenience during inclement weather.

Moreover, advanced cellular telephones, often referred to as smartphones, with inherent or native global positioning system (GPS) capabilities, are ubiquitous in society today. Thus, it is contemplated that smartphones may be used in the process of validating guests and providing access to guests into secured locations, such as through vehicle gates at residential communities. However, systems that may require guests and/or residents to download and install third-party or non-native applications, programs, or other software on the smartphone will likely cause the system to be less universal, more complicated in its use, and therefore, more likely to fail.

There is thus a need in the art for a system and method that can operate to manage invitations or access tokens corresponding to a guest or a guest's smartphone, for example. A website or webpage accessible by the guest's native smartphone web browser may be provided to authorize a guest to enter the community. Particularly, once an invitation is generated, an SMS or email may be communicated to the guest's smartphone with a unique link to a webpage. When the guest is within a proximate location or defined vicinity of the community (as determined by the native GPS capabilities of the smartphone), the guest can open the webpage and activate and open the gate.

Advantageously, the link or webpage may also include driving directions or a map (e.g., using Google Maps™ or Apple Maps™), as well as resident contact information (e.g., phone number, email address, etc. relating to the resident). A remote access control management system may store a detailed log of exactly when the gate was opened and for which resident(s). The resident(s) does not have to be home or in the vicinity for the guest to activate or open the gate. Furthermore, the access token or invitation, initiated via the SMS or email, may include a time parameter or time window of validity. Certain parties or entities (e.g., maintenance crew, management, delivery services such as UPS, FedEx, USPS, maids, pool cleaning crew, lawn care crew, etc.) may be provided access tokens which can be allowed for specific times of the day, certain days, and can be revoked at any time.

Additionally, the guest may forward the invitation or notification (SMS or email) to another device, for example, if the guest's plans change. Other embodiments may only validate the access token if activated by a particular authorized smartphone, phone number, or device. In addition, at least one embodiment of the present invention may include a one-time pass, meaning that the token or invitation may only be activated a single time. The one-time pass or one-time token may still include a time parameter, although once the token is activated by the guest, it can no longer be activated again. This prevents the guest from opening the gate or lock multiple times throughout the time parameter or time window, for example, in order to let other, non-authorized vehicles or parties through the gate. Of course, other implementations may include a frequency parameter greater than one, meaning that the resident, or other party who creates the token, can specify how many times the token can be activated within the particular time parameter (s).

Other advantages include reduced man power and expense for guest entry in that guard personnel workload is significantly reduced, and guests need not open the car window and expose themselves to the outer elements to gain access to the community.

In addition, some access control systems may employ user-created or user-defined personal identification numbers (PINs) to allow users to gain access to a location by entering the PIN on a keypad or electronic lock. However, manually created PINs have some significant drawbacks. For example, users often choose insecure patters, such as a birthday, repeated digits, etc. Also, keypads represent a single number space where collisions or duplicates are likely in a typical multiple dwelling community, such as apartment buildings and condominiums. Furthermore, PINs are often shared between a number of different guests, residents or users creating a weakness in security and causing the ability to restrict access based on access restriction parameters such as time and day to be difficult or not possible. Additionally, in these systems, PINs are stored locally at the access-controlled location, and therefore, adding or removing PINs to the system is time consuming, particularly for communities with multiple gates and entry points.

Furthermore, there may be instances where a guest may not have a smartphone or may not want to use a smartphone to enter a community or other access-controlled location.

Accordingly, it would be advantageous if the proposed system and method is able to generate a unique code, such as, but not limited to a numerical or other PIN code on demand and stored or managed via a remote server or remote access control management system. This would allow PINs to be unique, easily generated and deleted, and associated with restriction parameters, thereby increasing security.

SUMMARY OF THE INVENTION

As described herein, at least one embodiment of the present invention is directed to a system and method for verifying entry credentials and activating/deactivating an access control system in order to permit ingress or egress into a gated community or locked door, for example. Some embodiments may use of a guest's mobile device, whereas other embodiments may generate unique PIN or other codes that can be entered at the location.

In either event, an embedded computer system or control device that is structured and configured to actuate an electronic gate or lock (e.g., by way of a dry contact relay) may be provided. The control device is capable of utilizing a secure Internet (TCP/IP) or other network connection, such as SMS, to communicate with and receive commands from a remote access control management system, such as one or more web servers with one or more databases or other storage capabilities.

The remote access control management system of the various embodiments is structured to receive, track and manage invitations or access tokens that can be used to control access to the gated community or other secured area. Notifications that an access token has been generated can, in some embodiments, be communicated to the guest(s), resident(s), or other user(s) by way of text message, short message service (SMS), or email, for example. In some cases, the notification may contain a unique or entropic link or uniform resource locator (URL) to a webpage or website containing information related to the access token. The information may include, for example, specific time parameters within which the access token is valid, location parameters (e.g., the location of the gate or community), instructions on how to access or enter the community, contact information for the resident who initiated the invitation, etc. In addition, a map may be provided to show the location of the gate and/or the guest's current location.

When the guest is within the vicinity of the gate or community, for example, as determined by the native GPS capabilities of the smartphone, and if the time is within the specific time parameters of the access token, the guest may activate the access token to open the gate. Upon doing so, the remote access control management system will communicate an access command to the local control unit or device and log the activity. In certain embodiments, the smartphone or guest device will not communicate directly with the local control unit or computer system. Rather, the gate will only open when the remote access control management system sends an appropriate command. It should be noted, however, that the system and method may be implemented in order to allow direct communication between the guest device and the local control unit.

In some embodiments, the system and/or method may automatically locate one or more gates that are in range using the GPS capabilities of the guest device. For example, the system and method knows the location of the gates, and with the knowledge of the location of the guest, the guest can be informed of any and all gates within a predetermined or proximate location. Furthermore, using the GPS coordinates of where the guests or other users often open the gate(s), the system and method can re-define or fine tune the geofence. For instance, when a guest is near a gate and presses the 'open' button, the system and/or method of the present invention obtains and records the exact location or GPS coordinates of where the guest pressed the 'open' button. Depending on the layout of the streets and the gate, and other characteristics of a community for each unique location, sometimes guests may prefer to push the button further away from or closer to the gate. The information or data obtained with regard to where the guests typically press the button can be used to adjust the location of the geofence used to activate the 'open' button. For instance, if the guests often press the button close to the edge of the geofence, then it may be determined that the boundaries of the geofence should be extended slightly. In other words, the system and/or method of at least one embodiment includes a process to automatically or manually determine where the boundaries of the geofence should be located based upon the data obtained with regard to where the guests press the 'open' button.

A portion of the location of the geofence and the boundaries thereof is based on safety. Opening the gate only when the gate is not moving, and sometimes only when the vehicle is stopped, and in any case, only when it is safe to do so. Sometimes, however, the restrictions on when to open the gate, or where the geofence is located, can be burdensome to the guests, particularly if the geofence does not accurately reflect the path people actually drive to the gate. For example, in some cases, the gate may be large or wide where people often tend to stay to one side. If the geofence does not accurately cover the side which people tend to stay, the guest may drift out of the geofence, where opening the gate may not be possible. Accordingly, some embodiments allow for a form of data gathering and feedback from the users or guests in the form of determining where the guests press the 'open' button in order to provide an automatic adjustment to the location of the geofence or the boundaries thereof.

Furthermore, some embodiments may also generate and/or communicate a notification to the resident (or other authorized party) in order to indicate when the token is activated, for example, when the guest activates the token to open the gate and gain entry to the community. The notification may be via SMS, email, push notification, etc.

It should also be noted that certain embodiments of the present invention may be implemented using only the native applications or capabilities of a guest's device or smartphone, such as the native messaging services (text messages, SMS, email), native web browser, global positioning system, etc., such that additional software, application(s), or third-party program(s) need not be downloaded or installed on the guest device.

In other embodiments, the system and method may generate a unique PIN or other code that is associated with the guest access token. In such a case, the guest may enter the provided PIN or code into an input device, such as but not limited to a keypad, located at the access-controlled location. When the PIN or code is entered, it will be decoded and/or otherwise used to retrieve the guest access token and any access restriction parameters associated therewith. If the PIN or code is validated and all of the one or more access restrictions are confirmed or validated, entry will be granted.

These and other objects, features and advantages of the present invention will become more apparent when the drawings as well as the detailed description are taken into consideration.

BRIEF DESCRIPTION OF THE DRAWINGS

FIG. 11 illustrates an exemplary bijective transformation process as disclosed in accordance with at least one exemplary embodiment for generating an access code as described herein.

Like reference numerals refer to like parts throughout the several views of the drawings provided herein.

DETAILED DESCRIPTION OF THE INVENTION

Figure 1A:
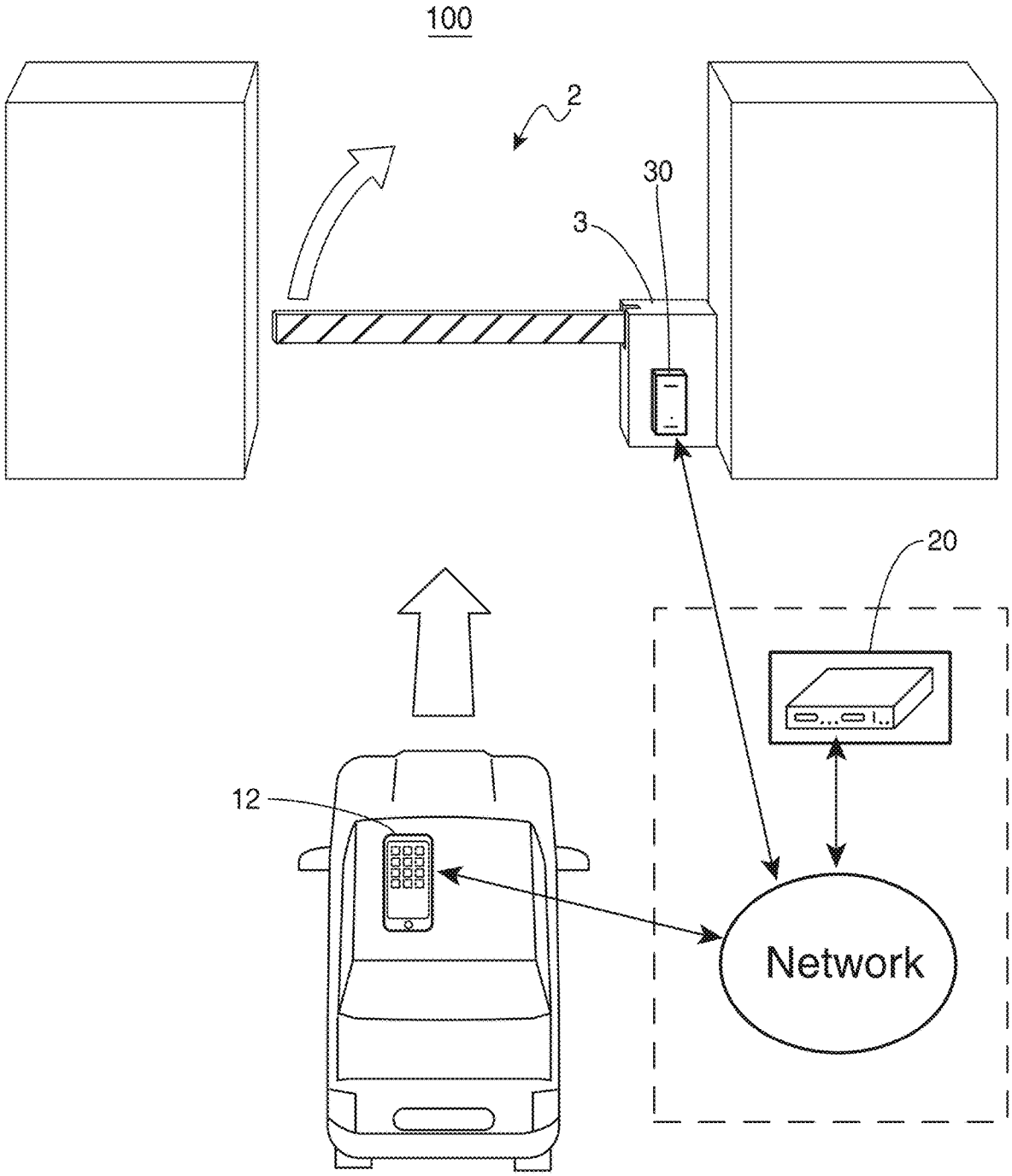
FIG. 1A is a schematic representation of the system as disclosed in accordance with at least one embodiment of the present invention implemented in connection with an exemplary vehicle gate.

As shown in the accompanying drawings, the present invention is directed to a system 100 and method 200 for verifying admission through an access-controlled location 2, including, but in no way limited to a vehicle gate (FIG. 1A), doorway (FIG. 1B), etc. Briefly, a resident or other authorized party may initiate the creation of an invitation or access token for a particular guest. The access token or invitation of certain embodiments may specify a guest or guest device and other access credentials or verification parameters such as a date, time, and location. The guest may retrieve the access token, prior to or upon arrival at the location, for example, via the guest device (e.g., smartphone or tablet). Upon verification of the access token, including the verification parameters (e.g., location and time), the guest may be granted access into the location.

Specifically, the various embodiments of the present invention include an access control management system, generally referenced as 20, which, as described herein, is structured and configured to receive requests for creating access tokens, generate and store access tokens, and, in some embodiments, communicate with the guest device(s) 12 and a gate, lock or other control device 30 for providing access to the location 2. Furthermore, in certain embodiments, the access control management system 20 may be positioned remotely from the location 2 wherein communication between the guest device 12 and the control device 30 may be conducted via a communication network 15, including, but in no way limited to the TCP/IP, World Wide Web, Internet, Wide Area Network, cellular or telecommunication network(s) such as 3G, 4G, LTE, SMS, etc. It is contemplated, however, that in certain embodiments, the access control management system 20 may be disposed locally to the location 2, such that communication with the control device 30 or gate, lock, etc. may be provided by short range communication channels, Bluetooth, WiFi, local area networks, NFC, etc.

Figure 2:
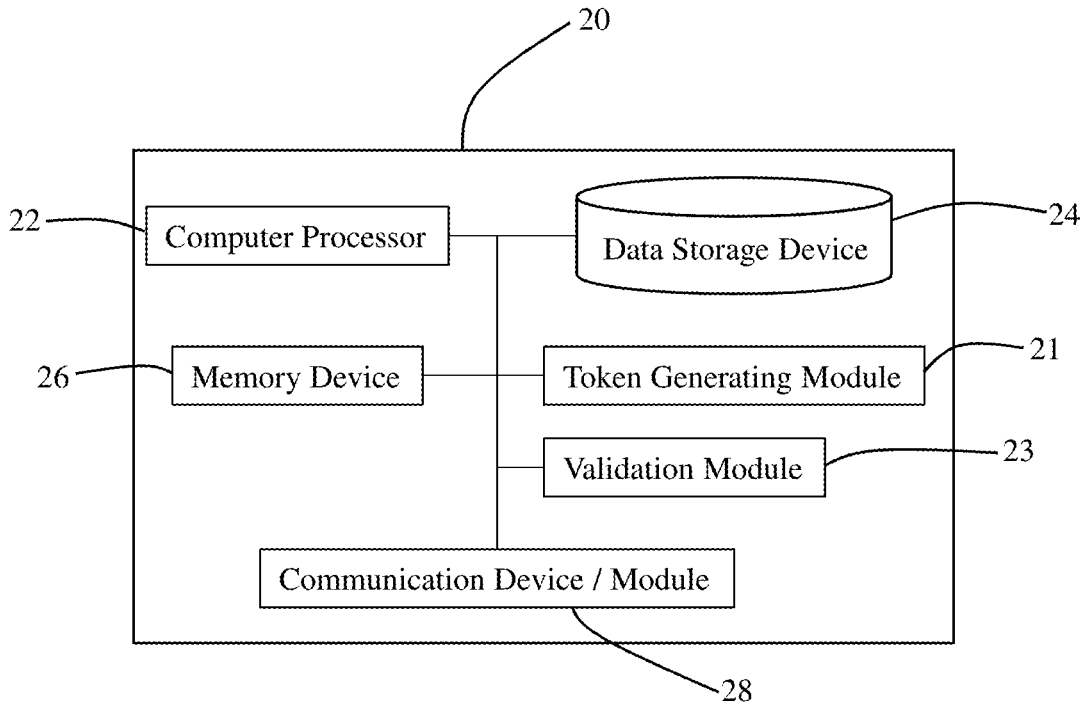
FIG. 2 is a block diagram of the remote access control management system and at least some of the components thereof as provided in accordance with at least one embodiment of the present invention.

Further, referring to the schematic of FIG. 2, the access control management system 20 of at least one embodiment of the present invention may include a computer processor 22, data storage device 24, memory 26, one or more communication devices or hardware 28 (e.g., network device(s), web server(s), etc.) Particularly, the access control management system 20 and/or processing device of at least one embodiment of the present invention comprises one or more web servers or data servers, including software and hardware to receive requests and to communicate data, information, media, web pages, applications, commands, SMS messages, text messages, email messages, etc. via the network 15 in accordance with the present invention.

More in particular, the computer processor 22 may include, for example, any device cooperatively structured to execute or implement computer instructions, software, etc. The data storage device 24, as used herein, may include one or more internal, external or removable hard disk drives, CD/DVD, USB drives, solid state drives, virtual drives, could-based storage drives, or other types of volatile or non-volatile memory. A relational or other database may be implemented on or within the one or more storage devices 24 of the present invention, for example, in order to store and retrieve various information or data corresponding to access tokens as described herein. Further, the memory device 26, may include but is not limited to random access memory (RAM) or other like devices configured to implement the present invention in the intended manner, for example, by at least temporarily storing and assisting with the execution of one or more applications or computer programs capable of implementing the system 100 and method 200 described herein. Moreover, the communication device 28 may include a network communication hardware/ software component or module structured to facilitate communication between the guest device(s) 12, control device 30, and/or a resident or other authorized device (not shown), for example, in order to receive a request to create an invitation or access token.

Figure 3:
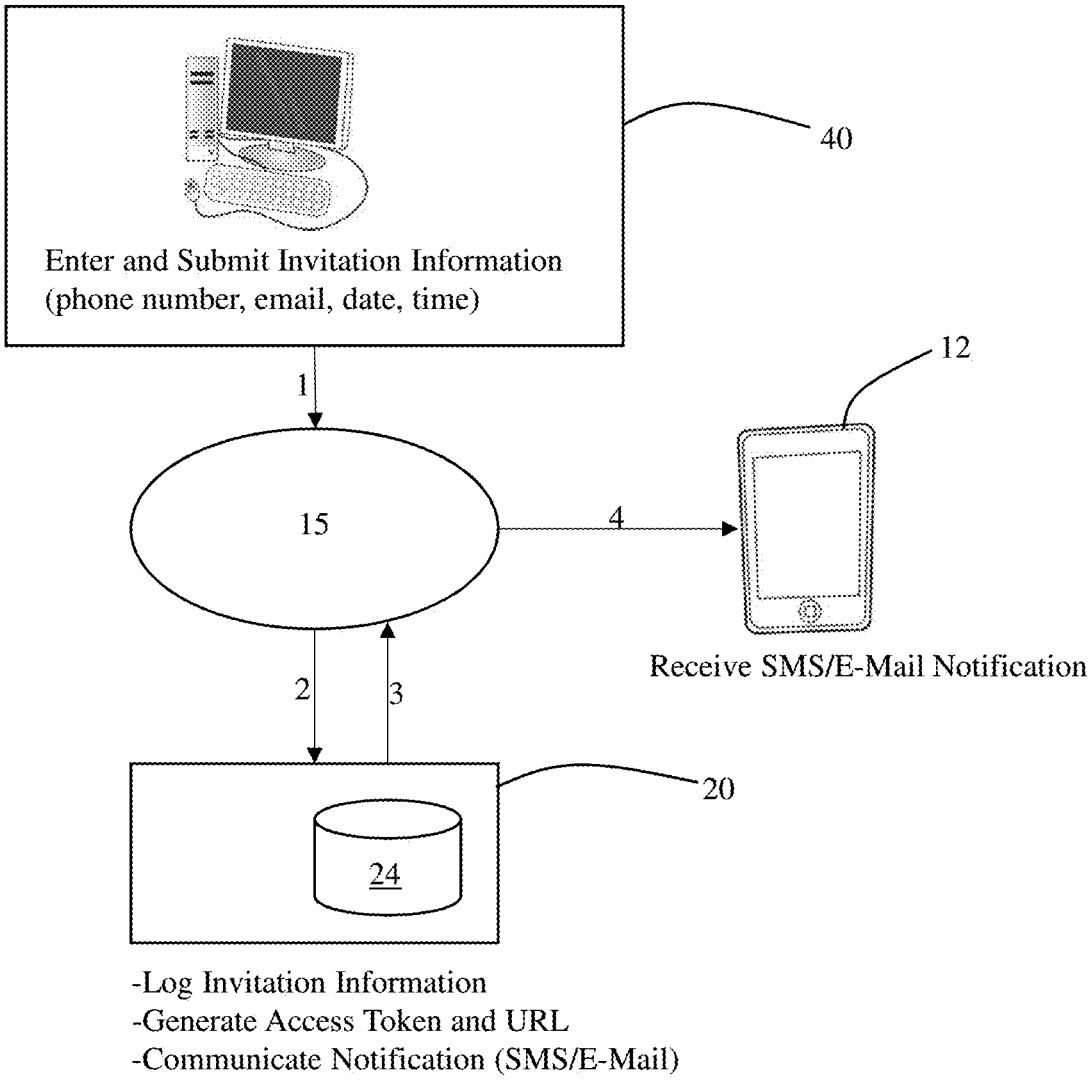
FIG. 3 is a schematic diagram illustrating the system of at least one embodiment and the creation of an invitation or access token.

Referring now to FIG. 3, and as generally referenced at 40, the system 100 and/or method may be initiated, for example, when an initiating party, such as a resident, security personnel, or other authorized party requests that an invitation or access token be generated. Accordingly, the system 100 of at least one embodiment comprises a token generating module, generally referenced as 21 in FIG. 2, for receiving a request to create a guest access token and for generating the guest access token. The token generating module 21 may comprise a computer program, application, software or series of computer instructions cooperatively configured to receive information corresponding to the access token and for generating the access token, as provided herein.

Figure 4:
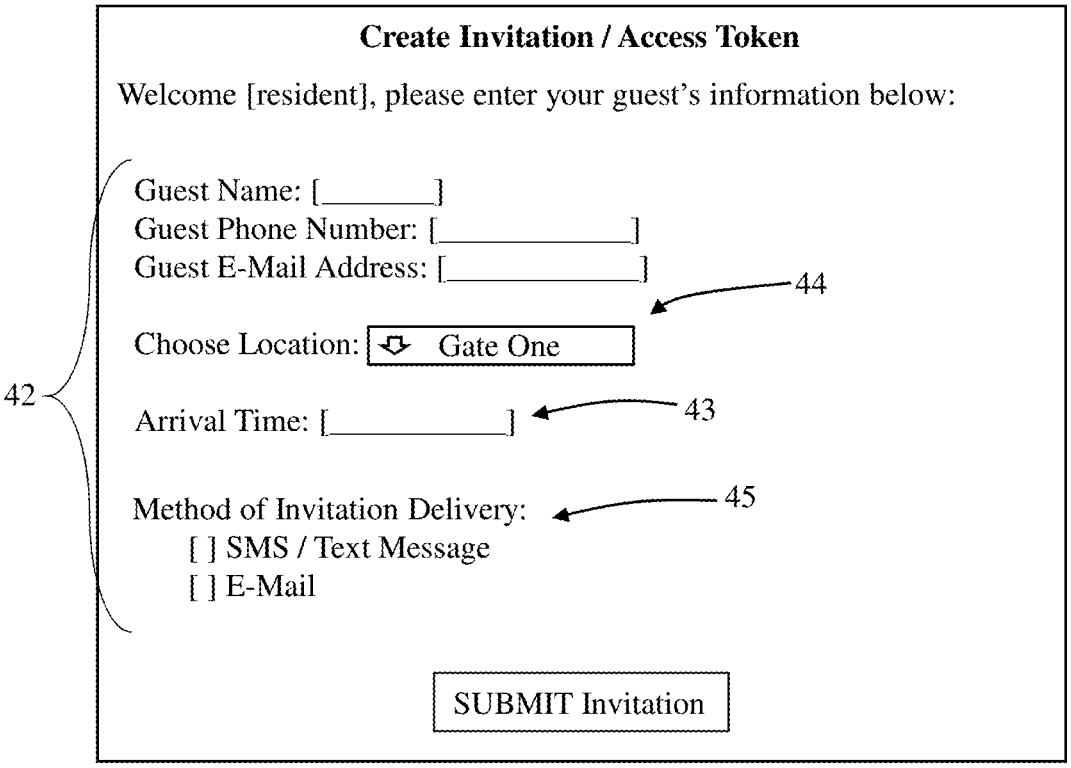
FIG. 4 is an exemplary schematic screenshot of the system of the present invention wherein a resident may initiate or create an invitation or access token.

Particularly, in at least one embodiment, a resident or other authorized party may provide various invitation information 42 (e.g., as shown in FIG. 4) corresponding to the particular guest access token to be generated. In certain embodiments, the initiating party may need to be pre-registered with the system 100 or method 200 of the present invention such that the party's authorization to request guest access tokens in accordance with the present invention may be verified. For example, as a resident, management personnel, security officer, etc. of a cooperating community, building, or other location 2, the party may be verified to provide or request guest access tokens. In this regard, the party may, in some implementations, need to pre-register with the system 100 or method 200 or otherwise sign up for or generate a user profile. It should be noted, however, that in many embodiments, the guest need not have an account or pre-register with the system or method in order to receive or otherwise be granted access into the location in the manners described herein. In some cases, the resident or other party initiating the request for access may also need not pre-register or have an account with the system or method.

In any event, in order to request a guest access token or invitation, in at least one embodiment of the present invention, the initiating party may visit a webpage, for example, via a web browser on a computer, laptop, smartphone, mobile device, tablet, etc. Other embodiments may include an application, software or other program, whether installed on the party's device (e.g., computer, laptop, smartphone, mobile device, tablet, etc.) or accessible thereby, which may be used to submit a request to generate an access token, as shown at 40, for example, in FIG. 3. Some embodiments may employ techniques to allow users or initiating parties to create an invitation or request a guest access token via manual voice and/or interactive voice response (IVR).

FIG. 4 represents an exemplary schematic of a webpage or other request form which the resident or other authorized party may access to submit a request for generating an access token. For instance, the invitation information 42 that can be submitted as part of the request may include, but is not limited to, the guest's name or identification information, a phone number or mobile directory number (MDN) corresponding to the guest's phone or device, an email address associated with the guest, etc. For instance, the phone number, MDN, etc. may be used as an SMS identifier in that the notification or access token presented herein may be communicated to the guest via the SMS identifier, such as the phone number or MDN.

Still referring to FIG. 4, the invitation information 42 may further include one or more access restriction parameters, including, but not limited to a time element or parameter 43, a location element or parameter 44, and/or a method or mode of delivering the access token to the guest 45. For instance, the time element 43 may be defined by one or more of an arrival time, a departure time, and/or a range or time window. Specifically, as described herein, the access tokens as provided in accordance with certain embodiments of the present invention include a time parameter wherein the access token is only active during the particular or defined time parameter. The time parameter may be defined by the time element 43 specified by the requesting party, for example, the arrival time, departure time, or range or time window. Other embodiments may define the time parameter of the access token as comprising a range or buffer (e.g., three (3), five (5), ten (10), etc.) minutes before and/or after the specified time element. As an example, the requesting party may identify an arrival time as ten o'clock (10:00). While some embodiments may define the time parameter of the access token in this example as ten o'clock (10:00), other embodiments may define the time parameter with a buffer allowing the access token to be active between 9:57 and 10:03, or between 9:55 and 10:05, for example.

Moreover, the location element 44 may be used to define the location parameter of the access token. In some embodiments, the location elements 44 and/or parameter may be predefined, for example, based upon the resident's or requesting party's profile. As an example, the requesting party may only have privileges to request an access token for a particular location, including, for example, the particular community in which the party belongs or lives. Accordingly, the location parameter may be predefined or preset based upon the requesting party's profile or access privileges. Other embodiments may allow the resident or requesting party to define the location element, for example, a particular vehicle gate, doorway, parking garage, etc. This may be particularly true when a single residential community has multiple vehicle gates, or when a single resident or profile has access privileges to multiple communities.

As shown at 45, certain embodiments may also allow the requesting or initiating party to specify the mode of delivering the access token or the mode of delivering a notification to the guest or visitor that an access token is available for viewing, retrieval or activation. While short message service (SMS) and email are shown as exemplary methods or modes of delivery at 45 in FIG. 4, other modes of delivery may be contemplated within the full spirit and scope of the present invention.

Figure 5:
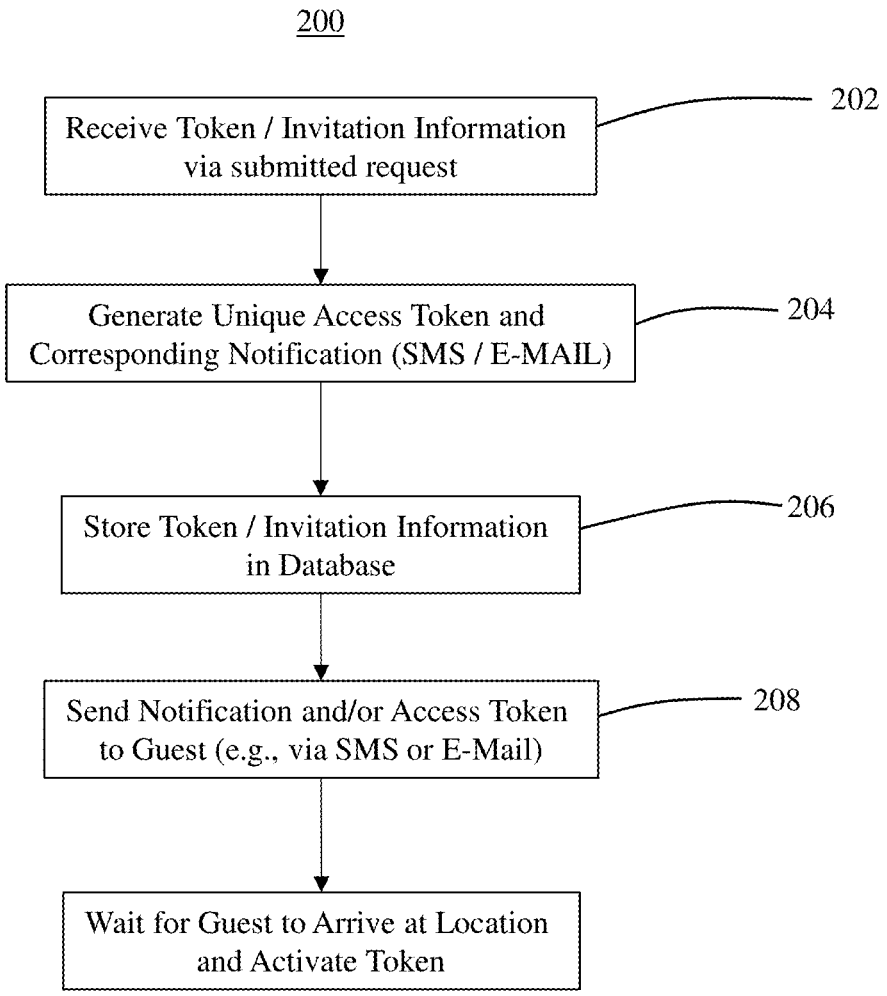
FIG. 5 is a high-level flow chart illustrating the method as disclosed in accordance with at least one embodiment of the present invention.
Figure 7A:
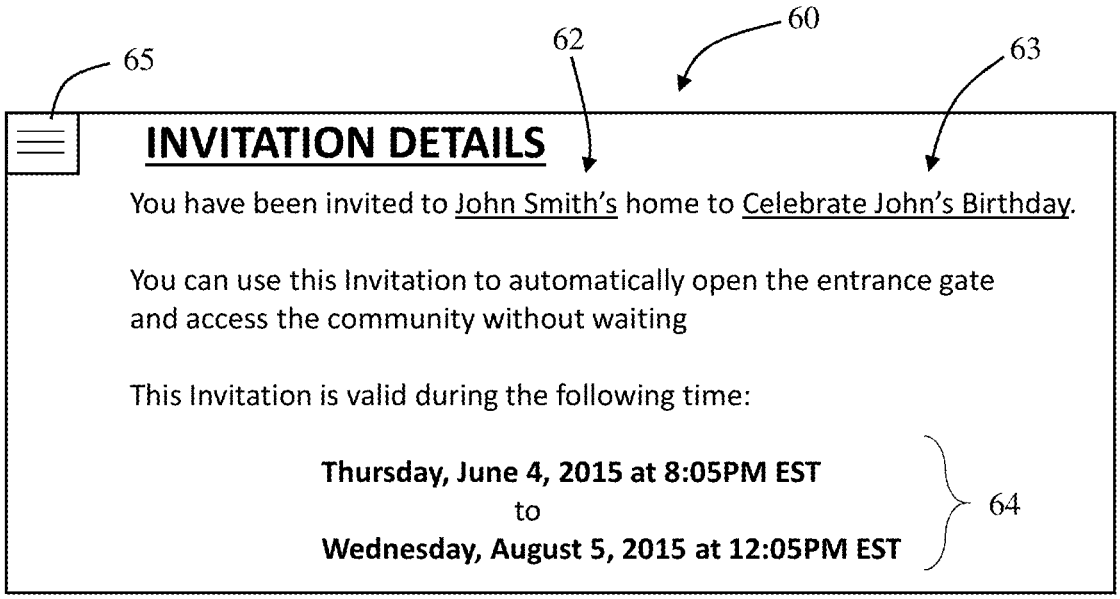
FIG. 7A is an exemplary screenshot of a portion of an access token providing time parameters as disclosed in accordance with at least one embodiment of the present invention.
Figure 7B:
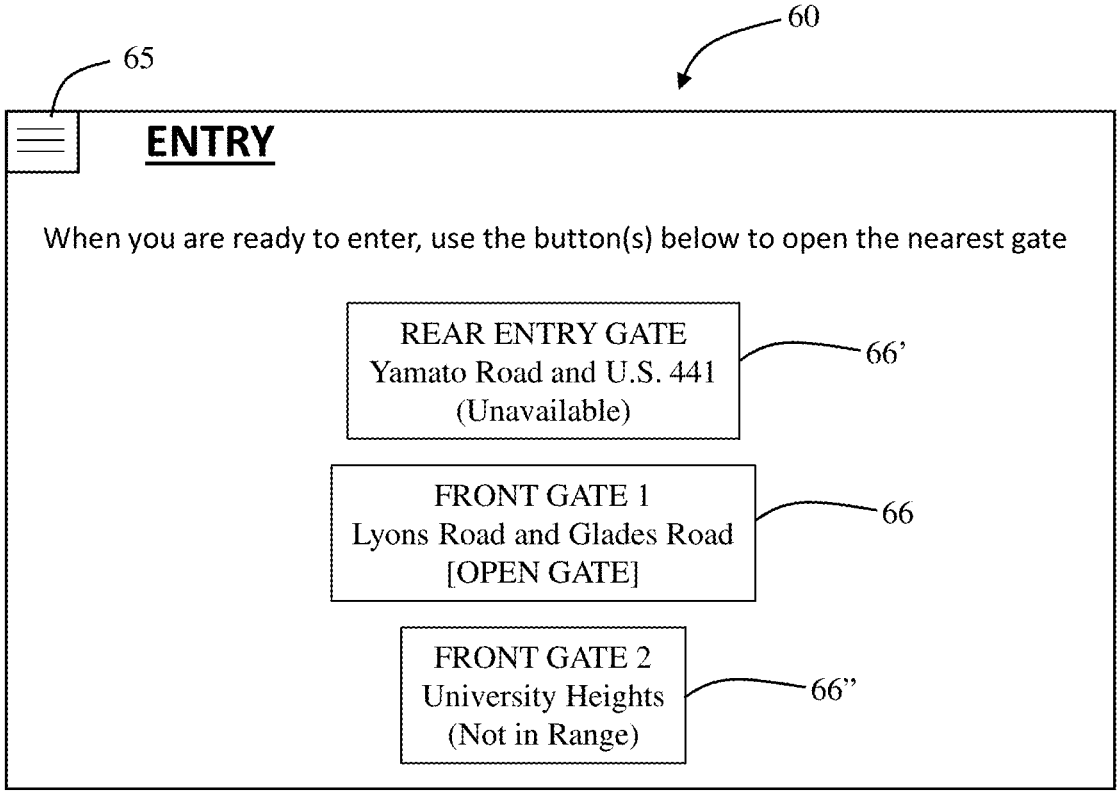
FIG. 7B is an exemplary screenshot of a portion of an access token providing activation buttons corresponding therewith.
Figure 7C:
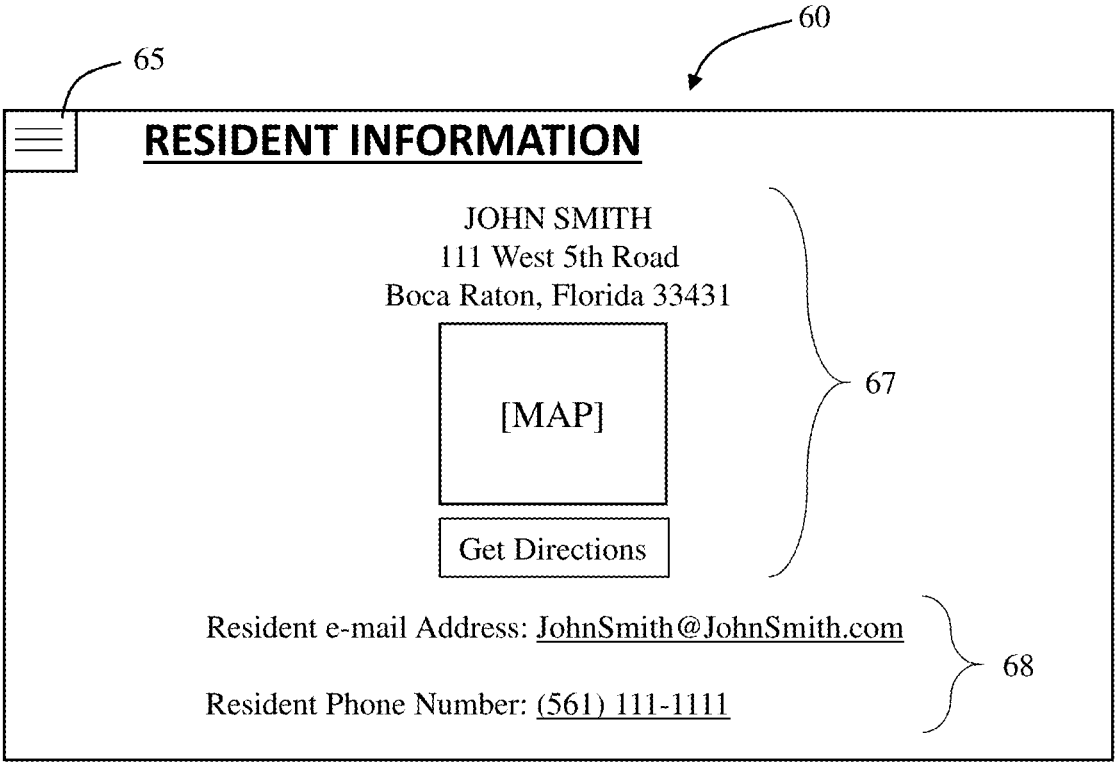
FIG. 7C is an exemplary screenshot of a portion of an access token providing a location parameter and resident information.

Upon submitting a request to create an access token, the access control management system 20 will receive the request, for example, via the network 15, as shown at 202 in the method 200 of FIG. 5. Accordingly, as shown at 204, the token generating module 21 of at least one embodiment of the present invention will generate an access token based at least in part upon the invitation information 42 contained in or as part of the request. Particularly, in at least one embodiment, the access token comprises a location parameter and a time parameter corresponding to the location element and time element of the request, as provided herein. For instance, the access token 60 (e.g., as shown in FIGS. 7A through 7C), as used herein, comprises a compilation or set of information, data, and parameters (e.g., guest information, location parameter, time parameter, URL), which, when verified by the system or method, can be used to gain access to the secure location. As provided herein, the access token may be stored in a database or other storage device and provided to the guest, for example, in the form of a dynamically generated HTML document.

For instance, generating the access token 204 in certain embodiments may also include generating a unique uniform resource locator (URL) and associating the URL with the access token or saving the URL as part of the access token. For example, the URL may be generated with random characters or with a certain amount or level of entropy such that the URL cannot be easily guessed. Systems and methods that are used to automate passwords, for example, may be used to generate at least a portion of the entropic or unique URL of at least one embodiment. The access token information, e.g., the location parameter, time parameter, and entropic or unique URL may be stored in a database, as shown at 206, for subsequent retrieval and activation.

Particularly, in at least one embodiment of the present invention, the entropic URL (e.g., the text of the URL itself) may be used to identify a guest and a password, or unique code, associated with that particular guest. For instance, the access information corresponding to a particular guest may be stored in a relational (or other) database and identified by a primary key. Along with certain access information (e.g., location parameter, time parameter, guest information, or resident information), a string or entry of random or entropic values is also generated and stored. In this regard, in at least one embodiment, the entropic URL may be generated by concatenating, intermixing, or otherwise combining the primary key (guest ID) associated with a guest and the entropic string or values (i.e. password). In order to provide further security or a greater perception of an entropic or random URL, a transposition on the buffer may also be executed.

For instance, an exemplary entropic URL of at least one embodiment of the present invention may look like this: "https://open.gate/v?ZK9FyliaLoas1ltLg9ULdGgqfjhFBlae". The "ZK9FyliaLoas1ltLg9ULdGgqfjhFBlae" portion of the exemplary URL includes the concatenated, intermixed or other combination of the primary key (guest ID) associated with the particular guest and the "password" (i.e., the entropic string or value saved within the relational database and corresponding to the primary key entry.) Thus, when the guest clicks on or activates the link or URL, the system and method of the present invention may be structured to decode or convert the entropic portion of the URL into the guest ID or primary key and the password or random values stored in the database along with the guest information and primary key. If the password matches what is saved in the database, then the system and method validates the URL and the guest.

Figure 6:
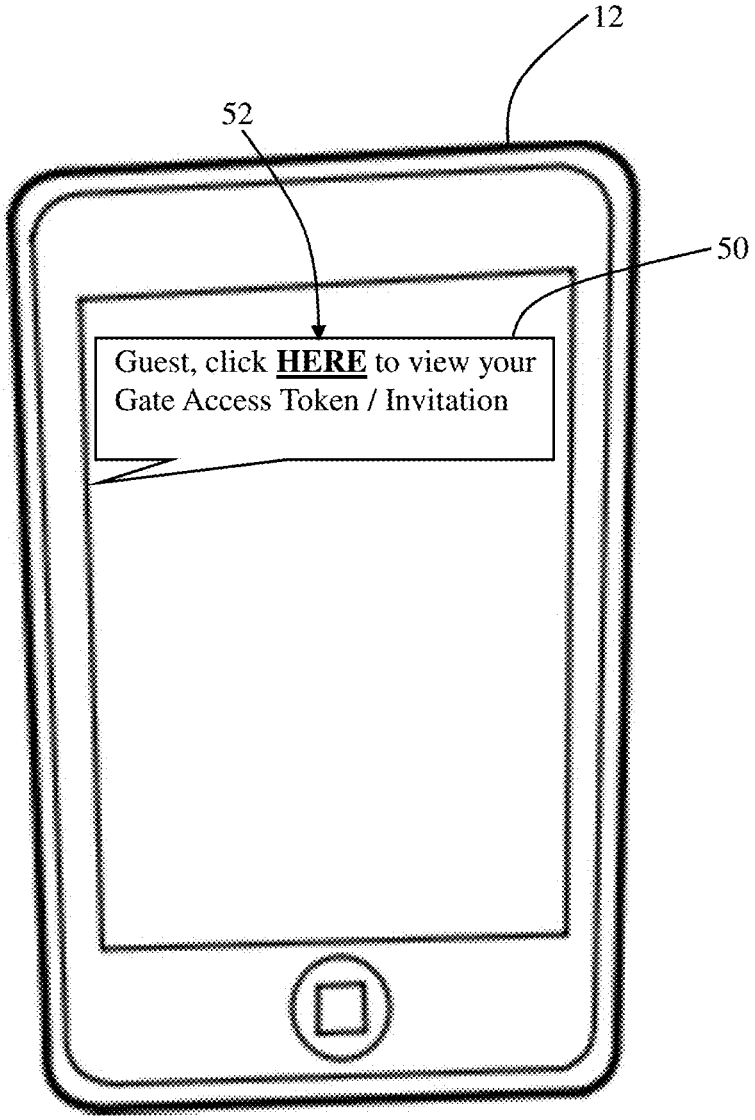
FIG. 6 is an exemplary illustration showing a notification received by the guest device in the form of an SMS message.

It should also be noted that the system 100 and method 200 of at least one embodiment may further generate a notification 50 (e.g., as shown in FIG. 6) containing the entropic or unique URL 52. The notification 50 may then be communicated 208 to the guest or guest device 12 allowing the guest to selectively retrieve or otherwise view the access token 60, for example, by activating or clicking on the URL 52.

For example, as shown in the exemplary schematic of FIG. 6, the notification 50 (including the URL) may be communicated to the guest device via text message or short messaging service (SMS). This allows the guest device 12 to use the native capabilities, e.g., the native text messaging or SMS capabilities of a smartphone or tablet, to receive the notification 50. Other embodiments may include communicating the notification 50 via email, which may also allow the guest device 12 to utilize the native communication capabilities, e.g., email capabilities, of the smartphone, tablet, etc. to view the notification. Advantageously, this means that no additional software, program or application is needed, beyond the native and common text message, SMS or email capabilities of the smartphone, tablet or other guest device 12 in order to view the notification 50 identifying the access token has been generated. It should also be noted that in certain embodiments, the access token 60 itself may be communicated to the guest device 12, for example, via text message, SMS or email, instead of the notification 50 or link to the token 60 as just described.

In some embodiments, a user's account or a guest access token may be limited to a defined number or a defined set of guest devices. This can be accomplished by implementing a reverse password feature that does not allow the guest device or a particular account to be accessed by more than a specified number of devices. Specifically, in at least one embodiment, the system or method can generate a unique identifier or 'reverse' password associated with each user account. The unique identifier or reverse password can be stored on the server, e.g., the remote access control management system, and is unique to each mobile device. In this manner, when a user, e.g., a resident of a community, first signs up with the system or method to create an account or when an existing user obtains a new phone or mobile device, the user would be able to contact an administrator, e.g., a person in charge at a community center or management office, who would be able to allow the mobile device to access the remote server or remote access control management system, where the reverse password would be communicated to the mobile device and stored locally thereon. In many cases, the reverse password will be stored in a user-inaccessible location on the mobile device. In at least one embodiment, for example, the administrator can set the account into a "programming" mode where the reverse password can be exchanged. In this embodiment, even when a resident or user provides his or her credentials, e.g., username and password, to another family member, friend or other person, that other person will still not be able to log into the account absent the reverse password being stored locally on the particular mobile device.

Figure 8:
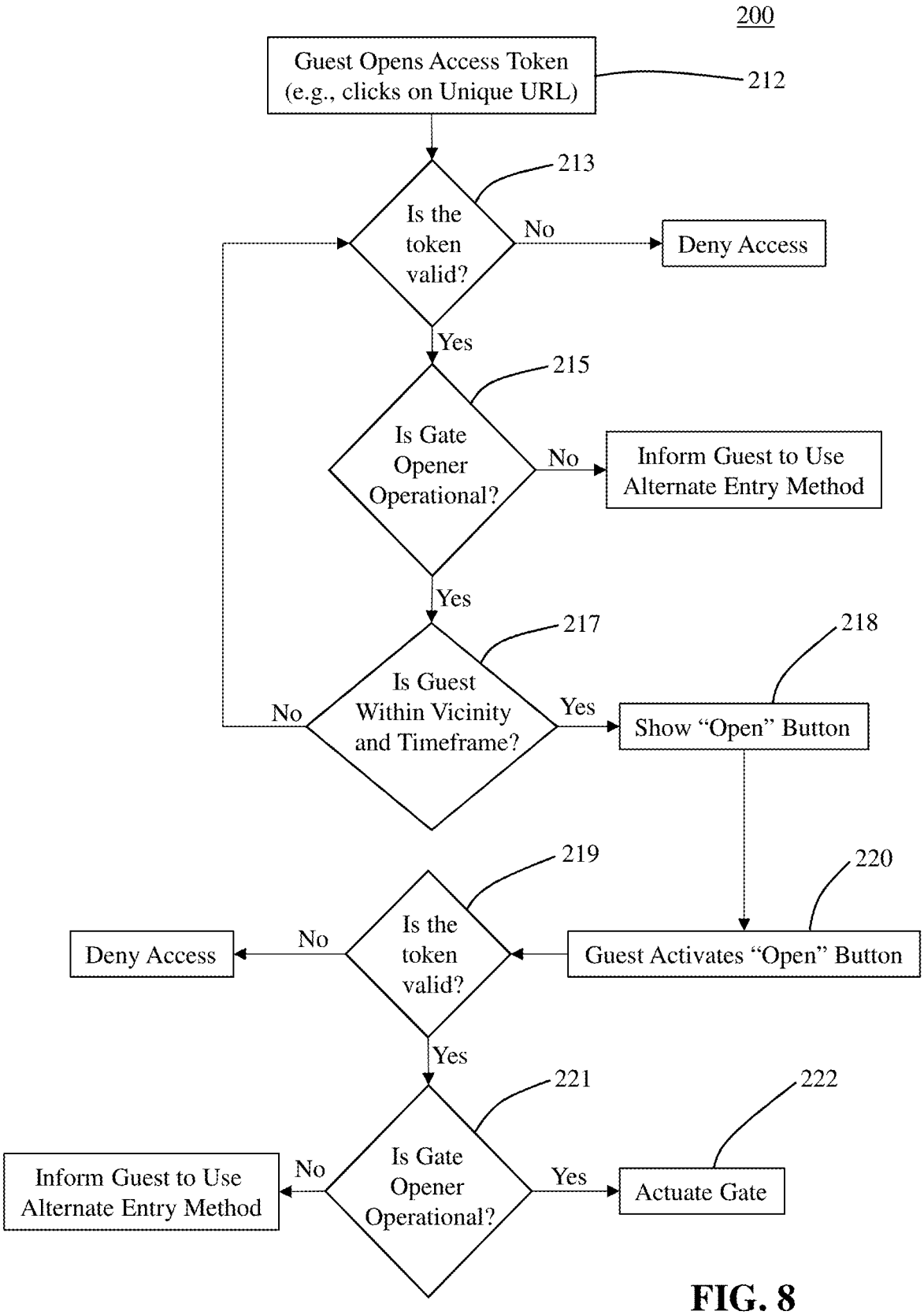
FIG. 8 is another high-level flow chart illustrating the method as disclosed in accordance with at least one embodiment of the present invention.

Still referring to the example illustrated in FIGS. 6 and 7A-C, and the flow chart of the method 200 illustrated in FIG. 8, however, when the guest wants to view or retrieve the details corresponding to the access token 60, he or she may click on, select or otherwise activate the URL 52 or embedded link, for instance, as contained in the notification 50 (e.g., SMS message), and as shown at step 212. Upon doing so, in at least one embodiment, dynamically generated content displaying the access token 60, for example, in the form of HTML or other web-based content, is generated and presented to the guest via the guest device 12. For instance, upon activation of the URL 52 or unique link, the access control management system 20 may retrieve the corresponding access token 60 from a database or other storage medium, for example, as described above via the primary key and password, and dynamically display the access token 60 via HTML or other web-based content. For example, using the primary key (or unique guest ID) and password (entropic value saved with the guest ID), the system and method can query the database or otherwise obtain the guest access information relative to the particular access token, such as what community the guest is visiting, which resident invited the guest, the location and time parameters, etc.

In this manner, the guest may view the access token 60 via the native capabilities of the guest device 12, for example, via a native or other web browser. Similar to viewing the notification 50, viewing the access token 60 of at least one embodiment does not require the use of or installation of additional, proprietary or third-party software, programs or applications. Rather, the guest may use the native or basic communication capabilities (e.g., text messaging or SMS capabilities, web browsing capabilities, etc.) of the device 12.

Particularly, for illustrative purposes only, FIGS. 7A, 7B and 7C show an exemplary access token 60 as disclosed in accordance with at least one embodiment of the present invention. For instance, as provided herein, the access token 60 may be presented to the guest or guest device via a web browser, although other methods of display are contemplated in certain embodiments. In particular, referring to the example shown in FIG. 7A, the access token 60 may include invitation details, such as the name of the resident 62 and an occasion or purpose 63 for the token 60. In the example shown, John Smith is the name of the resident and the purpose of the access token 60 is to celebrate John's birthday, although, of course, other residents and virtually any occasion can be specified. Still referring to FIG. 7A, the invitation or access token details may further include the time parameter 64, which specifies the time constraints relative to the access token 60, or otherwise, the time frame in which the access token 60 is valid.

If the access token information is provided on different or multiple web pages or displays, for example, as shown in FIGS. 7A through 7C, a navigation link 65 may be provided in order to allow the guest to navigate through the different portions or information relative to the access token 60. For instance, the guest may navigate between the invitation details, entry details and resident information via the navigation link 65. Other embodiments, however, may include all of the access token 60 information on a single webpage/display or different webpages/displays.

Referring now to FIG. 7B, exemplary entry details are shown. For instance, as provided herein, when the guest device is within the vicinity of the location parameter, such as via a predetermined algorithm, proximity function, or validation module, as provided herein, the guest may activate the button(s) and open the gate or unlock the door. Certain embodiments may provide multiple buttons 66, 66', 66", one for a different location, gate, or entry point. As an example, an unavailable entry point may be defined as a gate or access location that is not included in the group of valid entry points associated with the particular access token 60. Unavailable entry points may be identified as unavailable, as shown as 66', or left out all together in other embodiments. Other buttons 66" may indicate "out of range" or other equivalent to identify that the guest device is not close enough to the location parameter to activate the button 66". When the access device arrives within the vicinity, certain embodiments will automatically activate the button 66", for use by the guest, for example, as illustrated with reference to 66.

FIG. 7C illustrates further information associated with the invitation or access token 60, including, for example, the location parameter 67, such as, in the form of an address or a map. The map may be powered or provided by Google Maps™, Apple Maps™, or other external map API or service. Accordingly, the map of certain embodiments may not only show the destination location (or location parameter), but it may also identify the current location of the guest device. Resident information 68, such as the resident's email address and phone number may also be provided on the access token 60. In certain embodiments, the resident information 68 may be clicked on or activated in order to trigger native capabilities of the guest device (e.g., phone application to call the resident or email application to email the resident).

Referring back to FIG. 6, activation of the notification URL 52 or other link may, in certain embodiments, trigger one or more verification modules or authentication steps. Particularly, in at least one embodiment, the system 100 and/or method 200 of the present invention may determine whether the access token 60 is valid, as shown at 213 in FIG. 8. For instance, the resident may have previously revoked the invitation or access token, or management or residential/building security may have declined the request to create the access token. Also, if an error occurred during the request, the access token may be invalid. If, for whatever reason, the access token 60 is invalid, the method 200 will deny access to the secure location 2.

Other embodiments may also verify or determine whether the gate, lock or other device at the location 2 is operational, or determine whether the local control device 30 is operational, as shown at 215. If not, then the system 100 and/or method 200 may decline access or inform the guest to seek alternative forms of entry.

In any event, the system 100 includes one or more validation modules 23 structured to validate the time and/or location parameters associated with the access token, as generally illustrated in step 217 of FIG. 8. For instance, the time parameter may be validated or verified by analyzing or comparing the current time (as provided by the guest device 12 or as maintained by or for the access control management system 20, for example) with the time parameter associated with the access token 60. Specifically, as provided herein, in at least one embodiment, the access token 60 may only be valid during the particular time period defined by the associated time parameter. If the time parameter is not validated, for example, if the current time is outside of the time parameter associated with the access token, e.g., prior to or after the time parameter, then access will not be granted. The validation or verification of the time parameter in at least one embodiment may occur by a validation module 23 executed by or on the remote access control management system 20. This can minimize the potential for fraudulent or faked times that may be provided on the guest device. In order to maintain a level of security, the time indicated on the guest device 12 is not considered in some embodiments. Other, perhaps less secure embodiments may validate the time parameter on the device 12, itself, for example, via HTML, Java, JavaScript, C, C++ or other web-based code.

Furthermore, the various embodiments of the present invention include a validation module that is structured to determine or validate the current location of the device 12 as compared to the location parameter of the access token 60. For example, in one embodiment, the location parameter validation module may be activated upon the guest clicking on or otherwise following the entropic or unique URL 52 in the notification. As an example, doing so will not only display the access token 60 to the guest, such as via the native web browser and as shown in FIGS. 7A, 7B and 7C, but the method 200 of one embodiment will activate the native global positioning system (GPS) capabilities of the guest device 12 and, using the location parameter validation module, the system 100 and/or method 200 will determine the device's 12 proximity to the location 2.

For exemplary purposes only, in at least one embodiment, the location parameter validation module may be in the form of HTML and/or other code that is activated and processed on the device 12 itself upon selection of the URL 52. This maintains the location information of the device 12 on the device 12, meaning that the location information may not be communicated away from the device 12 in order for the system 100 and method 200 to determine whether the device is proximate the location 2. For instance, as provided below, the location parameter validation module of at least one embodiment may include or otherwise utilize the Haversine formula, as exemplified in the following code:

```
function toRad(d) {
    return d * Math.PI/180;
  }
  var EARTH_RADIUS = 6371009; // Meters.
  function distance(coords, lat, lon) {
    var d_lat = toRad(coords.latitude - lat),
      d_lon = toRad(coords.longitude - lon),
      x = 0.5 - Math.cos(d_lat)/2.0,
      y = Math.cos(toRad(lat)) *
        Math.cos(toRad(coords.latitude)),
      z = (1 - Math.cos(d_lon))/2.0,
      a = x + y * z;
    return (EARTH_RADIUS + coords.altitude) * 2.0 *
Math.asin(Math.sqrt(a));
  }
```

It should be noted, however, that other implementations of the location parameter validation module, whether processed on the device 12 or remotely, for example, by the remote access control management system 20, are contemplated within the full spirit and scope of the present invention. In any event, the location parameter of the various embodiments is validated or verified when it is determined by the system 100 and method 200 that the device 12 is within a predetermined proximity of the location 2.

If the location parameter and the time parameter are validated or verified, then the system 100 and method 200 of at least one embodiment will grant access to the location 2. For instance, referring to the exemplary illustration of the access token 60 provided in FIGS. 7A, 7B and 7C, and step 218 of FIG. 8, when the location parameter and the time parameter are validated or verified, then an "Open Gate," "Unlock Door" or other activation button, as generally referenced at 66 is presented, made visible, or able to be activated. Specifically, if the device 12 is proximate the location 2, and the current time is within the time parameter of the access token 60, then at least one embodiment will present the activation button 66 to the guest. Some embodiments may always show the activation button 66, regardless of the time or location of the device 12, although activation will not be valid unless and until the location and time parameters are validated or verified.

Upon activation, for example, as shown at step 220 when the guest activates or clicks upon the activation button 66, a message is communicated from the device 12 to the remote access control management system 20 identifying the unique access token 60 and the desire to open the corresponding gate or unlock the corresponding door. Some embodiments will perform a check to determine that the access token 60 is valid (step 219) and that the gate or lock is operational (step 221). For instance, in certain embodiments, the remote access management system 20 may store or maintain records corresponding to each gate or lock, and the current status of each gate and/or lock in order to inform the guest when or if the gate/lock is inoperable or out of service.

In any event, upon activation of the button 66, and after performance of any intervening validation steps, the remote access control management system 20 is structured to communicate an access command to the local control device 30, for example, via network 15, as shown at step 222 in FIG. 8. Particularly, the local control device comprises a computer-based device interconnected or communicatively disposed relative to the gate or operational components of the gate, for example, an access control mechanism 3 (e.g., as shown in FIG. 1A) corresponding to the gate or lock. As an example, the access control mechanism 3 (e.g., as shown in FIG. 1A) may include necessary mechanical and/or electronic components that operate to open/close the gate (e.g., by pivoting the gate upward/downward or moving the gate along tracks) or to lock/unlock a door. Upon receipt of the access command from the remote access control management system 20, the control device 30 will operate to open the gate, unlock the door, etc.

For instance, many electronic or vehicle gates as well as electronic door strikes operate via leads that, when connected, will open the gate or unlock the door for example. The local control device 30 of at least one embodiment of the present invention may be configured to drive a relay or other mechanism that controls the lead(s) and actuates the gate. Of course, other gate structures are contemplated, for example, digital control mechanisms that may control the gate. In such a case, the control device 30 of the present invention may be an external or separate device that is configured to control the digital or other control mechanism that operate the function of the gate or door, such as opening, closing, locking, unlocking, etc.

In any event, the control device 30 may be triggered or activated by a command, for example, from the access control management system 20, via an SMS message or a secured TCP/IP communication channel, including, but not limited to a secure, persistent channel or socket, etc. Thus, the control device 30 may include an Ethernet, WiFi or cellular interface for communicating with the access control management system 20. In any case, it is important in some embodiments that the access control management system 20 know whether the local control device 30 is available or unavailable on the network or communication channel. This can be accomplished via a "heartbeat" message, ping message and/or a periodic message communicated from the control device 30 to the access control management system 20 notifying the access control management system 20 that the control unit is connected and operational, or otherwise identifying the operation status of the control device 30. Thus, if a heartbeat or ping message is not received, the access control management system 20 may conclude that the control unit is unavailable, for instance, in the event of a network or hardware failure.

Furthermore, because security is important in the various embodiments of the present invention (i.e., whether SMS, TCP/IP or other communication channel is implemented between the local control device 30 and the access control management system 20), the local control device 30 may be implemented to only respond to authorized commands. For instance, in the case of implementing a TCP/IP communication channel between the local control device 30 and the access control management system 20, SSL with cryptographic authentication of the messages may be appropriate. If SMS is used as the communication channel, validating the mobile originated (MO) device and providing an embedded "key" in the message may be appropriate.

For example, the control device 30 of at least one embodiment may be functioning as a server with the function of receiving commands from the access control management system 20 and opening the gate or unlocking the door, for instance, when directed to do so. In the case of a TCP/IP communication channel between the control device 30 and the access control management system 20, the control device 30 may be assigned a static IP address such that its network address or location on the network(s) is known to the access control management system 20. However, as this approach may be undesirable in many cases, the control device 30 may be configured to continually, persistently or periodically communicate an outbound connection or signal to the access control management system 20 (rather than receive an inbound connection). In such a case, the local control device 30 need not be assigned a static IP address in order to consistently communicate with the access control management system 20 and in order for the access control management system to know the network address or location of the local control device 20. The access control management system 20 can, therefore, store or park the connection received by the control device 30, allowing the access control management system 20 to use that established connection (provided from the control device 30) when necessary, for example, when the access control management system 20 is ready to send a command. The access control management system 20 may, in some implementations, include a static IP address, such that the local control device(s) 30 can always locate it on the network 15 and send the connection signal. Thus, the control device 30 and the access control management system 20 may communicate on the secure, persistent channel established or initiated via the local control device 30.

Furthermore, as mentioned herein, to detect a communications failure, network failure or hardware failure, the control device 30 may periodically attempt to send a heartbeat or ping message to the access control management system 20 in order to test the integrity of the connection. In certain embodiments, the heartbeat or ping message may include status information relative to the control device 30 (e.g., CPU or other temperature measurements and hardware health).

If the control device 30 does not receive or detect a response to the ping message, then it will continually attempt to connect to the access control management system 20. Because the access control management system 20 may include redundancy, this should only result in a short outage as the control device 30 attempts to reconnect.

The advantage to this is the ability for the system and method to operate on low bandwidth and without the need for a static IP at the control device 30, as well. Other firewallNAT issues are overcome.

This allows the access control management system 20 to keep track of, or otherwise maintain a steady and up-to-date status of the control device(s) 30, including temperature information and hardware health, for example, simply by receiving the ping message. If the connection is severed, or if the status of the control device 30 is poor, then the access control management system 20 can convey this information to the guest so that alternative means for entry may be sought. Additionally, in at least one embodiment, when the guest clicks on the URL to retrieve the access token, the access control management system 20 may already know the status of each of the control device(s) corresponding to the access token 60. Particularly, querying the status of the control device 30 does not need to be done at the time of activating the URL (which may result in a waste of bandwidth). Rather, the access control management system 20 of at least one embodiment is internally aware of the status of the control device(s) 30. This allows the access control management system 20 to mark certain gates or entry points as available or unavailable.

Furthermore, a single access control management system 20 or a single (set of) server(s) or computer(s), can service a plurality of gates or control devices 30 for a number of different communities. Particularly, rather than having a separate server or set of servers for each community, the present invention may be implemented with a common set of servers to manage a plurality of communities. In this manner, the access control management system 20 must have an understanding as to what guests are allowed access to what gates, which residents can invite guests through which gates, and the corresponding security barriers. For instance, a resident of community A should not be able to invite a guest into community B without being a resident of community B.

Moreover, the access token or webpage that displays the access token to the guest(s) may be customized for each community, for example. As provided above, the webpage or HTML content may be dynamically generated upon activation of the corresponding URL. Retrieving the information corresponding to the access token (e.g., guest information, location parameter, time parameter, resident information) may also include retrieval of customized community information relative to the look and feel of the webpage. The community information may thus include selected colors, names, logos, a particular layout, etc. This allows each community to customize the access tokens and web interface with their colors and logos, for example, despite sharing a server or set of servers with hundreds or even thousands of other communities.

In addition, certain control parameters, including, for example, a relay closure time parameter, may be stored on or by the remote access control management system 20 or otherwise provided by the remote access control management system 20 to the local control device 30. Particularly, oftentimes, various control parameters, such a relay closure time, are required to effectively operate the controlled opening and closing of the gate, and may vary depending on a particular gate or lock configuration. Accordingly, rather than storing certain control parameters locally on the control device 30, they may be stored on the access control management system 20 and communicated to the control device 30, for example, with the activation command. Specifically, with regard to the relay closure time, this allows the length of time in which the gate/door remains open or unlocked to be controlled by the remote access control management system 20. It also allows the system 100 and method 200 of the various embodiments to be implemented in a number of different applications, such as vehicle gates, vehicle garage gates, electronic door strikes, lobby doors, etc. Furthermore, the control device 30 does not need to be reconfigured if it is damaged, for example, and universal control devices 30 may be used to control vastly different gates, lock, etc. In addition, the control parameters can be changed remotely at any time, without requiring on-site servicing of the control device 30. Maintaining the control parameters on the access control management system 20 also allows the parameters to be easily backed-up—a failure in storage device, either by the control device 30 or the access control management system 20, therefore, does not mean all of the control parameters are lost.

Further advantages of at least one embodiment of the present invention includes a hierarchically implemented database structure in which a group of guests can be managed by the resident as a single unit, which can be useful for parties, group gatherings, for instance. As an example, the database hierarchy of at least one embodiment may be implemented by defining a "community" that contains one or more "residents," a "resident" owns zero or more invitations" or tokens, an "invitation" contains one or more "guests," and a "guest" contains zero or more "visitation records." Thus, a single "community" may be defined as including a plurality of residents, each of which can manage invitations for guests. A single invitation may be assigned to a plurality of different guests. This is what allows the resident to easily define or manage group invitations. For instance, each defined guest may activate the invitation or access token during the defined time parameter and within the defined location parameter. The resident may thus define a single time and location parameter which may apply to a plurality of different guests.

Additional features of at least one embodiment of the present system and/or method may include a location check or clock in/clock out feature. For example, some communities may be concerned about external workers or service technicians within the community, particularly in the event those worker or individuals stay within the community after the work is completed or come to the community in advance of the scheduled work. It would not be desirable to allow a worker or service technician (e.g., plumber, electrician, handyman, etc.) into the community, and then allow that individual to roam about the community after the work is completed. Therefore, in at least one embodiment, the guest(s) may be required to periodically check into the system/method via his or her mobile device to ensure that the individual is exactly where he/she should be during the scheduled maintenance or other work. The system/method can use the GPS or other location capabilities of the mobile device to determine the location of the guest, and to determine whether the guest is at the location (e.g., a particular home within the community) performing the scheduled work or maintenance. If the guest is unable to check in, or if the guest is not in the correct location associated with the access token, then a notification will be generated. That notification can be communicated to the resident or user who requested the guest token, an administrator of the system or method, a community manager, or emergency personnel, such as police officers or security guards.

It should be noted that while the system 100 and method 200 of the exemplary embodiments provided herein are at least partially implemented or accessed via native capabilities of a guest device (e.g., smartphone or tablet), certain embodiments may be implemented using a downloaded application structured and designed to operate the various steps and functionality of the present invention.

Figure 1B:
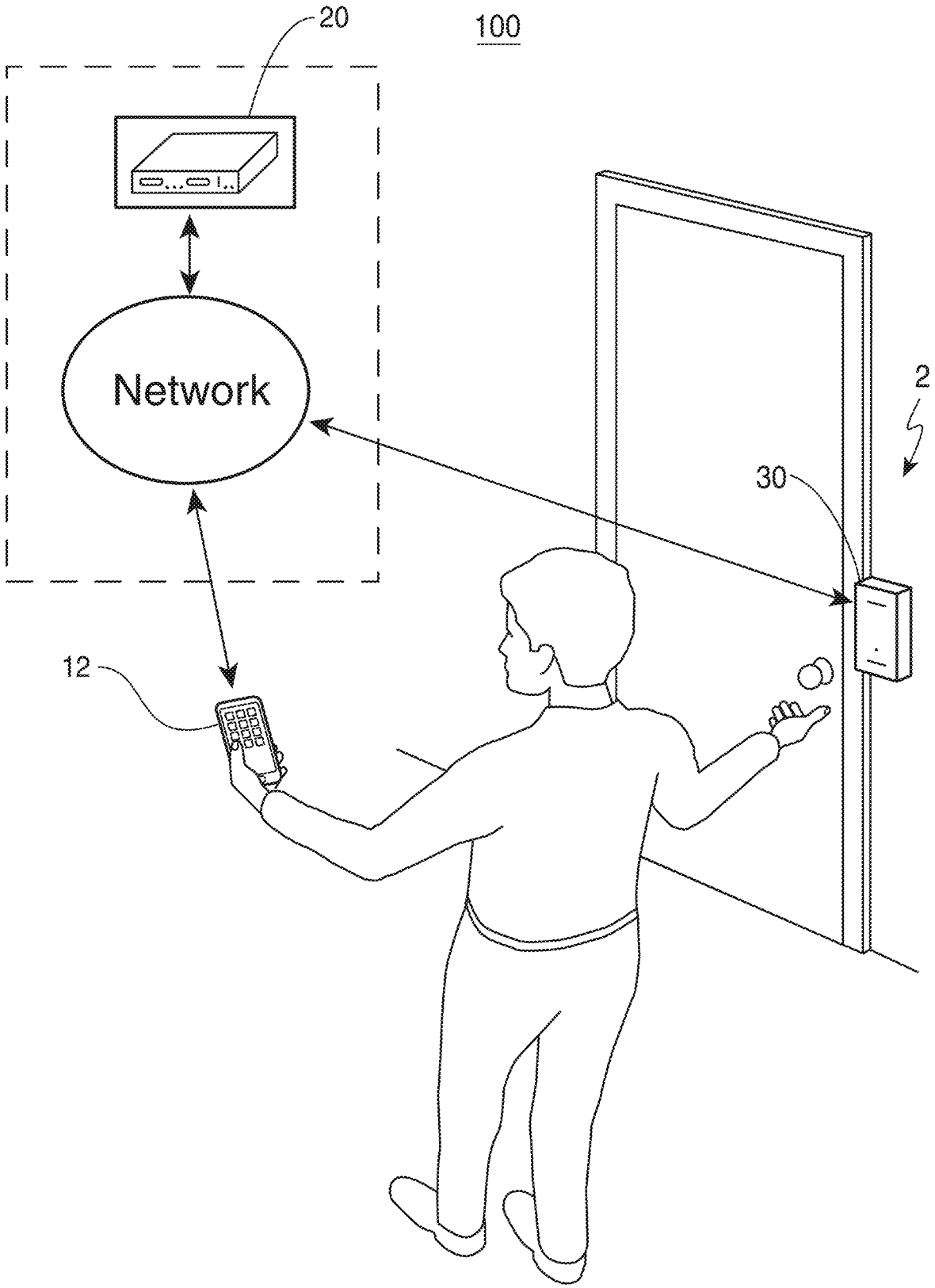
FIG. 1B is a schematic representation of the system as disclosed in accordance with another embodiment of the present invention implemented in connection with an exemplary door lock.
Figure 9:
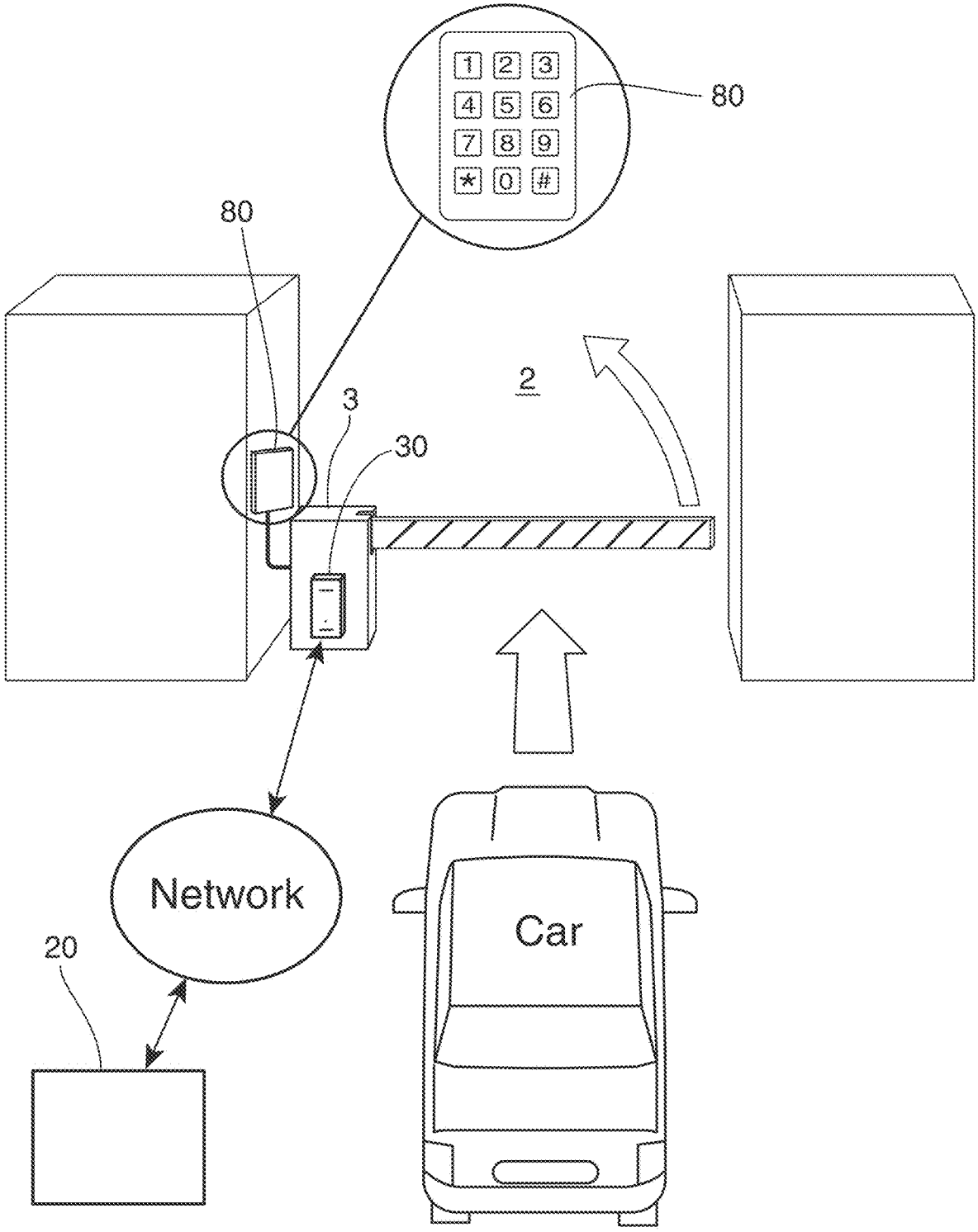
FIG. 9 is a schematic representation of the system as disclosed in accordance with another embodiment of the present invention implemented in connection with an exemplary vehicle gate.

With reference now to FIGS. 9 through 12, yet another embodiment is illustrated. Particularly, FIG. 9 illustrates an entrance or access-controlled location 2 with an input device 80. The input device 80 is configured to receive an input from a guest, resident or other user, as described herein. In this manner, the input device 80 may be in the form of a numerical keypad, as illustrated, with a plurality of numerical keys, although virtually any input device 80 is contemplated within the full spirit and scope of the present invention, including a touchscreen input device, alpha-numeric keypad, voice or audio input device, etc. It should also be noted that other access-controlled locations are contemplated, in addition to residential gates, including doors or electronic locks, as represented in FIG. 1B, for example.

Figure 10:
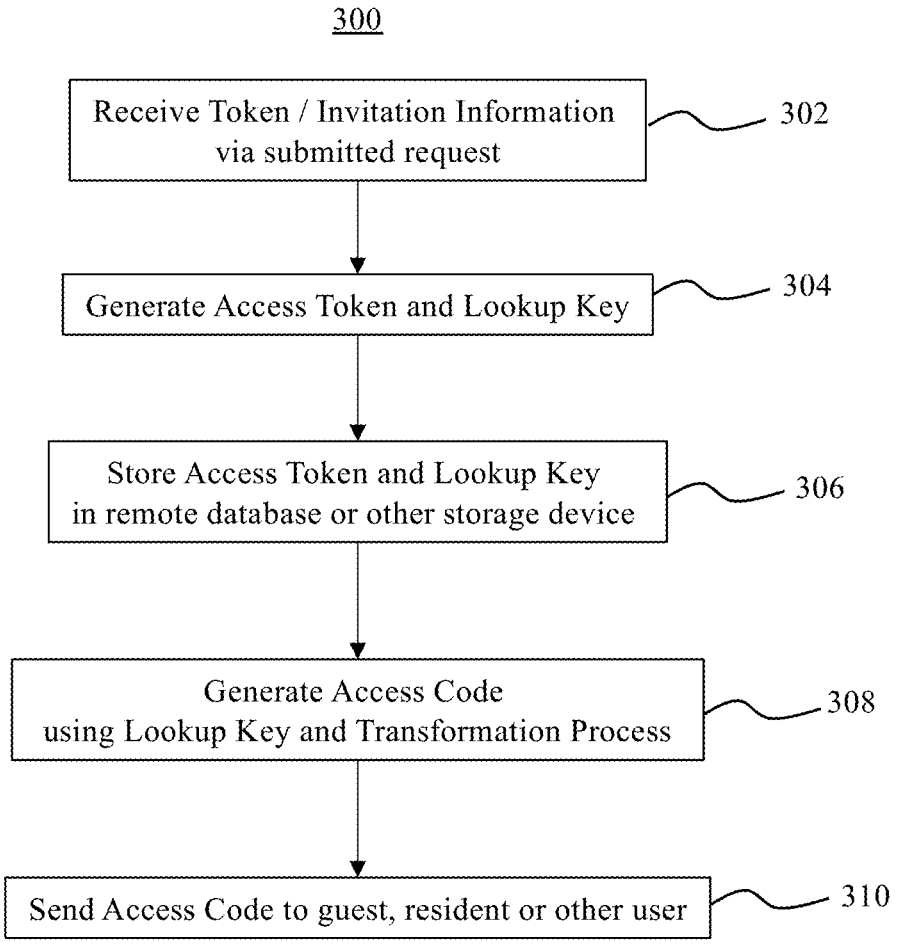
FIG. 10 is a high-level flow chart illustrating the method as disclosed in accordance with at least one embodiment of the present invention.

In any event, FIG. 10 represents a high-level flow chart for the method 300 that receives a request to generate an access token and that generates a unique code, as described herein. For example, at represented at 302, the method 300 of at least one embodiment includes receiving token or invitation information via a request to create an access token. As represented in connection with other embodiments herein, the request can include various invitation information, such as the guest's or other user's name, phone number, address, e-mail address, etc. One or more access restrictions may also be defined, such as a time parameter, date parameter, or location parameter. In this manner, the unique code will only be able to be used to open the gate or enter the location if all of the restriction parameters are satisfied.

When the remote access control management system 20 receives a request to create an access token, in some embodiments, the requester may need to specify whether the access token will be accessed via a mobile device (e.g., using a URL, as described in accordance with other embodiments herein) and/or via the entry of a PIN or other unique code. In either case, the remote access control management system 20 or method 300 of at least one embodiment will generate the access token and a lookup key, as shown at 304. The access token can be generated in a similar manner as described herein with regard to other embodiments. In at least one embodiment, the lookup key may be sequentially generated, meaning that the lookup key is a numerical value increased by one as compared to the immediately preceding lookup key. Further, the lookup key may be unique to each access token and may thus be used as a primary key in the case of a relational database storage system. In other words, the access token and the lookup key are stored in the database or other storage system 306 in a manner such that the access token can be retrieved using the lookup key.

Next, in the embodiment where an access code or PIN is to be used, the system or method 300 will generate a unique access code. In at least one embodiment, the unique access code is generated using the lookup key. In this manner, the access code can be generated on demand, for example, upon receipt of a request to create an access token. In many cases, in order to discourage malicious actors or people from attempting to enter sequential or adjacent codes, the access code should not appear to be sequential. In addition, the access codes should be unique across all users of the system. This allows the system and method 300 to enforce access restrictions for each user or each guest, and it allows the system and method 300 to remove the access code on-demand, thereby preventing further or subsequent use. Moreover, the access codes of at least one embodiment of the present invention should appear random, and therefore, distinguishable between users.

One approach for generating an access code may be to generate a random number each time, and then search for existing or active access codes for a possible duplicate. If a duplicate is found, then a new random number can be generated followed by another collision search for a duplicate. This approach, however, has some disadvantages. For instance, as the list of access codes increases, the collision search will take a longer amount of time to complete. It also requires a need for a random number source or generator and each lookup by access code requires a search of the table.

Accordingly, in at least one embodiment of the present invention, generating the access code 308 may allocate lookup codes sequentially, but apply a transformation process 350 or function to the lookup codes to create an access code that may appear to be randomly or pseudo-randomly generated. In at least one embodiment, the transformation process 350 may be bijective, or otherwise injective and surjective, such that a one-to-one mapping between the sequentially generated lookup key and the access code is preserved.

Additionally, in at least one embodiment, a check digit can be added to the access code via the transformation process or function. As just an example, the check digit can be computed using known techniques or algorithms such as a Luhn or Damm function. Of course, other functions or processes can be used to generate the check digit of certain embodiments or implementations of the present invention. As will be described below, the check digit allows endpoints to perform an early validation of an input entered into the input device 80, such as the keypad at the location 2.

Referring now to 11, an exemplary transformation process or function is illustrated. For example, in line 2, the SeqNo refers to the sequentially generated number that is used as the lookup key. Particularly, each time a new request to generate an access token is received, the lookup key or SeqNo will increase by one. This number (e.g., the lookup key) may then be XORed with a key, as represented in line 2, in order to ensure a more even distribution of bits and/or to further randomize the value. For instance, in at least one embodiment, the key shown in line 2 may be a community specific, secret key, which may be binary, ASCII, or in some cases have a numeric or alphanumeric value. Particularly, if an unauthorized person were able to estimate the number of PIN codes created for a community (for example, based on the size of the community, the number of residents, etc.), then he/she could then simply try random PINs of a certain range in the hopes of finding a valid one. With the use of the key in line 2, this type of attack is made more difficult, particularly if the key is specific for each community. For example, if an attacker learns that the system or method is installed at a new community, the attacker may assume that the sequential base of PINs is quite low. However, because the sequential value is mixed or in some cases XORed with a community specific secret key, the attacker would not have a good starting point for guesswork.

Furthermore, still referring to at least one exemplary transformation process as shown in FIG. 11, in line 3, a mask is generated for a portion of the value that was obtained from line 2. In line 4, the bits outside of the mask are extracted, and in line 5, the bits inside the mask are extracted. In line 6, the inside portion is rotated, and then in line 7, both the rotated inside portion and the outside portion are combined. The length of the output is padded to a required length and, in some implementations, the check digit is added. This will then create the access code, which can then be used to access the location, assuming the access restrictions, if any, are also validated.

Particularly, in at least one embodiment, the check digit may be a single digit or multiple digits prepended to the front of the PIN or access code, although in other cases, the check digit can be added in the middle or to the end of the PIN or access code. The check digit may be computed from the final hashed value, for instance, using known or new techniques, as mentioned above.

It should be noted that the process shown in FIG. 11 is presented as exemplary and should not be deemed limiting. Other transformation processes or functions are contemplated within the full spirit and scope of the present invention.

For instance, referring again to FIG. 10, as shown at 310, the access code is then communicated to the guest, resident or other user. This can be accomplished in any one or more ways, including via text or SMS messaging, email, phone call, push notification on a mobile device, etc. In many cases, the access code will be a four (4) digit numerical code, although virtually any length is contemplated, and in some cases, the code may be alphanumeric.

Figure 12:
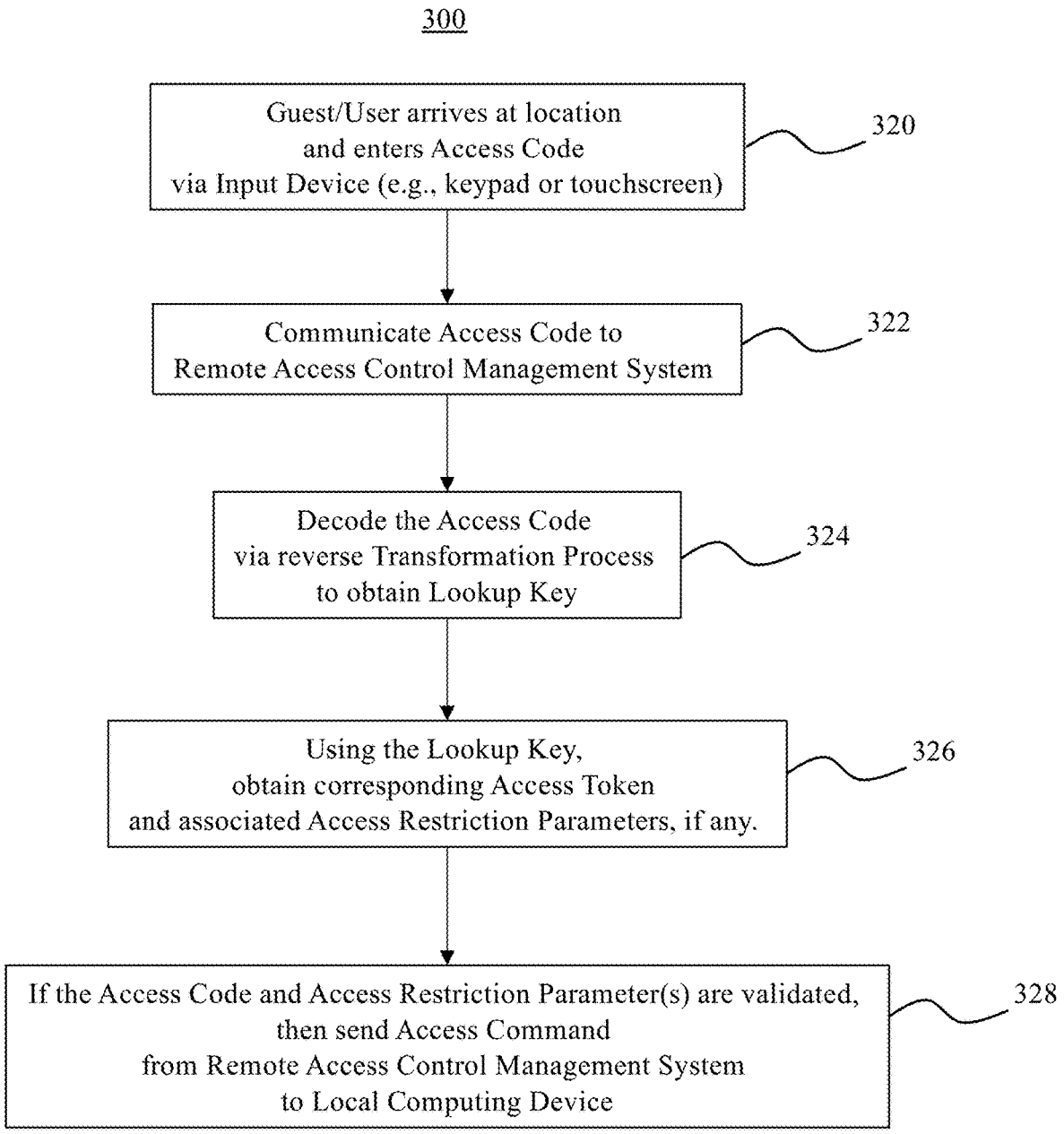
FIG. 12 is another high-level flow chart the method as disclosed in accordance with at least one embodiment of the present invention.

FIG. 12 is a high-level flow chart illustrating the process of at least one embodiment initiated when a guest, resident or other user enters a code into the input device 80 at the access-controlled location 320. Particularly, as shown at 322, the input code or the code that was entered by the guest, resident or other user, is communicated to the remote access control management system via the network or other communication link.

Further, in at least one embodiment, wherein the access code includes a check digit, the check digit may be validated first via early validation process. For example, the check digit allows endpoints to perform an early validation of an input entered into the input device 80, such as the keypad at the location 2. The early validation can be beneficial in reducing network traffic particularly when the database and storage of the access codes and access tokens is remote and requires a network or telecommunications link. In this regard, typos and simplistic attacks can be required to be validated prior to querying the database.

It should be noted that the check digit and early validation may be an option in that it may not be used in every instance. For example, in the event the local computing device communicates with the remote access control management system via a cellular modem or other low bandwidth network, then the early validation may be performed locally, via the local computing device. In such a case, the local computing device will first analyze the entered PIN or code, and determine whether the entered PIN or code contains the correct check digit. If it does, then the local computing device will upload or otherwise communicate the entered PIN or code to the remote access control management system for further validation, as disclosed herein. If the entered PIN or code does not contain the correct check digit, then the local computing device, in at least one embodiment will not communicate the entered code to remote access control management system.

In other embodiments, for example, in embodiments where bandwidth is of little or no concern, the early validation of the check digit may be performed remotely via the remote access control management system. In this case, each time a code or PIN is entered by a guest or other user, the local control device will communicate the entered PIN or code to the remote access control management system. An early validation process may be performed server side or otherwise by the remote access control management system prior to fully decoding or otherwise prior to further validation of the entered PIN or code. In addition, the remote access control management system may also log or store the codes or PINs communicated by the local control device. In the case where each of the entered PINs or codes are communicated, the remote access control management system may log or store all of the codes or PINs even if they do not pass early validation.

Next, at 324, the input code is decoded in order to obtain the original sequentially generated number or lookup key. For instance, in one embodiment, the transformation process or function can be reversed to reveal or obtain the lookup key. Then, at 326, the lookup key can be used, for example as a primary key in a relational database, to find the access token associated therewith. If the lookup key created via the input code is valid, meaning that there is an access token associated with the lookup key, and that access token is valid, then the system or method will determine if there are any access restriction parameters associated with the access token. If there are any access restriction parameters, such as date, time or location, as described herein, those access restriction parameters will need to be verified or validated prior to allowing access into the location. If the access restriction parameter(s) are validated, then the remote access control management system 20 of at least one embodiment will communicate an access command to the local computing system 30 to open the gate or door 328, as described herein.

It should also be noted that with a centralized database or storage system, e.g., that provided by the remote access control management system 20, access codes can be created and deleted or deactivated on demand or on the fly simply by updating the database or other storage device or system. In this regard, access to visitors, guests, residents and other users or individuals can be granted or revoked from anywhere and at any time.

Additionally, in a number of instances, residential communities and locations often have multiple entrances, each with a different gate. At least one embodiment of the present invention allows a single database or a single management system 20 to control or manage each of the different entrances. In other words, a single PIN or access code can be used to gain access to any of the different gates of a common community.

Additional features of one or more embodiments of the present invention may also include a lockout period beginning when a guest or other user gains access to the location (e.g., via the mobile phone URL embodiment or the access code embodiment) and ending a predefined amount of time thereafter, such as, 30 seconds or less to 10 minutes or more. In this embodiment, the gate or other access lock will not open during the lockout period. This form of anti-passback is designed to prevent, restrict or minimize tailgating through the gate.

Furthermore, the system and method of the various embodiments of the present invention is capable of tracking guests, residents and other users who enter the community. This tracking can be used in a number of different manners including providing analytics and feedback as to who entered the community, how many people entered the community and when people entered the community. In this regard, the guest access tokens can be linked to a particular resident or residence, and thus, the system and method can track and analyze how many guests have entered the community for a particular resident within a particular time. This information can be used to detect locations of parties or violations of community rules pertaining to guests and the like.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

What is claimed is:

1. A method for verifying admission through an access-controlled location, the method comprising:

receiving a request at a remote access control management system to create an access token for admission through the access-controlled location, the access token comprising at least one access restriction parameter, the remote access control management system comprising a computer processor, memory, a storage device and a communication module, generating the access token and generating a lookup key, storing the access token at the remote access control management system wherein the access token is retrievable via the lookup key, generating a unique access code using the lookup key, the unique access code comprising a series of digits, receiving a request to access the access-controlled location by receiving the unique access code from a user physically present at the access-controlled location, the unique access code being entered on an input device located at the access-controlled location, communicating the unique access code received from the user to the remote access control management system, decoding the unique access code received from the user at the remote access control management system to obtain the lookup key, using the lookup key, obtaining the at least one access restriction parameter of the access token, and if the at least one access restriction parameter is validated, then granting access to the access-controlled location by communicating an access command from the remote access control management system to a local control device at the access-controlled location.

2. The method as recited in claim 1 further comprising defining generating the lookup key as comprising increasing a numerical lookup key associated with an immediately preceding access token by one.

3. The method as recited in claim 2 further comprising using a bijective transformation process to map the lookup key to the unique access code.

4. The method as recited in claim 1 further comprising defining the unique access code as comprising a check digit.

5. The method as recited in claim 4 further comprising performing an early validation process via the local control device at the access-controlled location using the check digit prior to decoding the input code to obtain the lookup key, the early validation process comprising determining whether the unique access code received from the user at the access-controlled location comprises the check digit, if the unique access code received from the user does comprise the check digit, then communicating the unique access code received from the user to the remote access control management system, if the unique access code does not comprise the check digit, then access into the access-controlled location is denied.

6. The method as recited in claim 1 further comprising periodically communicating a status signal from the local control device at the access-controlled location to the remote access control management system, the status signal comprising status information associated with the control device.

7. The method as recited in claim 6 further comprising determining, at the remote access control management system, if the control device is available or unavailable for entry, and if the control device is unavailable for entry, communicating information from the remote access control management system to a guest device identifying that the control device is unavailable in order for the guest to seek an alternative manner of entry.

8. The method as recited in claim 7 further comprising establishing a secure, persistent communication channel between the local control device and the remote access control management system for communication of the access command from the remote access control management system to the control device.

9. The method as recited in claim 8 wherein the secure, persistent communication channel is initiated via the status signal from the control device to the remote access control management system, and the method further comprises periodically storing, at the remote access control management system, information corresponding to the secure, persistent communication channel initiated by the status signal from the control device.

10. A method for verifying admission through at least one of a plurality of associated access-controlled locations, the method comprising:

receiving a request at a remote access control management system to create a guest access token for admission through any one of the plurality of associated access-controlled locations, the guest access token comprising at least one access restriction parameter, the remote access control management system comprising a computer processor, memory, a storage device and a communication module, generating the guest access token, generating a lookup key, storing the guest access token at the remote access control management system, wherein the guest access token is retrievable via the lookup key, generating a unique access code using the lookup key, receiving a request to access one of the plurality of associated access-controlled locations by receiving the unique access code from a user physically present at the one of the plurality of access-controlled locations, the unique access code being entered on an input device located at the one of the plurality of associated access-controlled locations, communicating the unique access code to the remote access control management system, decoding the unique access code at the remote access control management system to obtain the lookup key, using the lookup key, obtaining the at least one access restriction parameter of the guest access token, and if the at least one access restriction parameter is validated, then granting access to the one of the plurality of associated access-controlled locations by communicating an access command from the remote access control management system to a local control device at the one of the plurality of associated access-controlled locations.

11. The method as recited in claim 10 further comprising using a bijective transformation process to map the lookup key to the unique access code.

12. The method as recited in claim 10 further comprising defining the unique access code as comprising a check digit.

13. The method as recited in claim 12 further comprising performing an early validation process using the check digit prior to decoding the input code to obtain the lookup key.

14. The method as recited in claim 10 wherein each of the plurality of associated access-controlled locations represent a different entrance into a common residential community.

* * * * *